United States Patent [19]

Müller et al.

[11] Patent Number: 4,902,865

[45] Date of Patent: Feb. 20, 1990

[54] PUSH-PULL ACTUATOR FOR KEY SWITCHES

[75] Inventors: Herbert Müller, Schwarzenfeld; Gerhardt Sehnke, Sulzbach-Rosenberg, both of Fed. Rep. of Germany

[73] Assignee: Siemens Aktiengesellschaft, Berlin and Munich, Fed. Rep. of Germany

[21] Appl. No.: 273,755

[22] Filed: Nov. 16, 1988

Related U.S. Application Data

[63] Continuation of Ser. No. 72,115, Jul. 10, 1987, abandoned.

[30] Foreign Application Priority Data

Jul. 23, 1986 [DE] Fed. Rep. of Germany ..... 3624946

[51] Int. Cl.[4] ..... H01H 15/24

[52] U.S. Cl. ..... 200/538; 200/318.2; 200/334

[58] Field of Search ..... 200/538, 537, 540, 318.2, 200/334, DIG. 42

[56] References Cited

U.S. PATENT DOCUMENTS

| | | | |
|---|---|---|---|
| 3,567,874 | 3/1971 | Strobel | 200/77 |
| 3,718,793 | 2/1973 | Obszarny | 200/77 |
| 4,618,747 | 10/1986 | Schaffeler | 200/440 |

FOREIGN PATENT DOCUMENTS

| | | | |
|---|---|---|---|
| 7805186 | 6/1978 | Fed. Rep. of Germany . | |
| 2839108 | 3/1980 | Fed. Rep. of Germany | 200/77 |
| 3002169 | 7/1981 | Fed. Rep. of Germany . | |
| 3207725 | 9/1983 | Fed. Rep. of Germany . | |
| 645201 | 9/1962 | Italy | 200/77 |
| 2169142 | 7/1986 | United Kingdom . | |

*Primary Examiner*—Renee S. Luebke

*Attorney, Agent, or Firm*—Kenyon & Kenyon

[57] ABSTRACT

The invention relates to a push-pull actuator for key switches with a mushroom knob (1) which is loaded by a restoring force and is supported longitudinally movable. This mushroom knob (1) is separated from the actuating plunger. This actuating plunger is spring-loaded in the switching direction and is locked in the operating position by rocker levers (13). The locking is cancelled by a relative motion between the mushroom knob (1) and the actuating plunger (6) by the sliding of inclined surfaces (23) at the edges of the rocker levers (13) so that the actuating plunger is moved into the off position by the spring (20). In the off position, the rocker levers (13) with the back sides (19) are brought into engagement with the end faces (18) of the rocker levers.

5 Claims, 1 Drawing Sheet

PUSH-PULL ACTUATOR FOR KEY SWITCHES

This application is a continuation, of application Ser. No. 072,115, filed July 10, 1987, now abandoned.

BACKGROUND OF THE INVENTION a. Field of Invention

The invention relates to a push-pull actuator for switches with a biased, longitudinally supported movable mushroom knob coupled to a plunger for actuating the switch contacts. The actuating plunger has selectively activated detent means both in the on and off positions.

b. Description of the Prior Art

In a known push-pull actuator (DE-GM 78 05 186), an operating detent slot is made sufficiently long that, as long as switching cannot take place by the force of a spring, a mechanical separation of the contacts can still be performed. Disengagement of the operating detent is accomplished by a separate key which only makes it possible to rotate the mushroom knob. In addition, a spherical element is used which is not secure and may be removed by force.

In another known push-pull actuator for key switches of the above-mentioned type (German Patent 30 02 069) the push-pull actuator may not be unintentionally defeated to interrupt the current by rotating the mushroom knob in the rest position. However interruption of the current may not be avoided in the presence of heavy vibrations.

SUMMARY OF THE INVENTION

In the current invention, a simple push-pull actuator of the above-mentioned kind is provided. The present invention ensures that an inadvertent interruption of the current by the switch, due for example to heavy vibrations is prevented. This is achieved in a simple manner in a push-pull actuator of the above-mentioned type by the provision of an actuating plunger which is spring-loaded separately from the mushroom knob and in a direction opposite the direction of switching. Furthermore, relative motion between the mushroom knob and the actuating plunger is used for cancelling at least one detent and a coupling or solid connection is provided between the mushroom knob and the actuating plunger only at the end region of the mushroom knob travel. The actuating plunger can be equipped with relatively little weight and since the mushroom knob and the actuating plunger are separated from each other, the weight of the mushroom knob for actuating the actuating plunger in the case of vibration is no longer a decisive factor. Also, to make the detent stable enough so that it is not affected by vibration, it is advantageous if the detent is accomplished by spring-loaded latches secured to the housing which engage with recesses or projections formed on the actuating plunger and which can be disengaged by inclined surfaces of the mushroom knob. In order to facilitate lifting or disengaging the latches for actuating the push-pull actuator, an arrangement has been found to be advantageous in which the latches consist of rocker levers which can be pivoted out by a sliding bushing which is fastened to the mushroom knob, said bushing surrounding the actuating plunger with a sliding fit. In order to use the same latches for locking the actuating plunger in both the "ON" position and the "OFF" position, it is further of advantage if the rocker levers have locking recesses for the engagement of one side of the projections of the actuating plunger in the "ON" position and the end faces of the rocker levers are matched to another sides of the projections in such a manner that the actuating plunger can be locked in the "OFF" position. In order to avoid the rebounding or chatter of the actuating plunger and thereby possible contact interruptions, it is furthermore of advantage if the end faces of the rocker levers and the sides of the projections are grooved transversely to the tilting direction of the rocker levers. The setting of the push-pull actuator from the tripped or "OFF" position can be accomplished by rotation of the mushroom knob in the operating position to capture the plunger and pull it back to the "ON" position in a manner similar to German Pat. No. 30 02 169. However, it may also be desirable to permit the setting of the switch to the "ON" position only by qualified personnel, where it has been found to be advantageous if the mushroom button has an opening on the front side, through which the actuating plunger can be reached. The actuating plunger is then pulled back by means of a key or a special tool through said opening with the mushroom knob pushed. The opening on the front side can additionally be used as a tripping indicator for the push-pull actuator.

BRIEF DESCRIPTION OF THE DRAWINGS

An embodiment example according to the invention will be described, making reference to the drawings wherein.

DETAILED DESCRIPTION OF THE INVENTION

Figure 2:
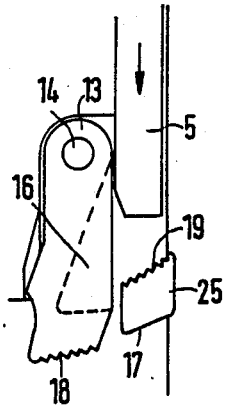
FIG. 2 a partial view of the position of the rocking levers.

The push-pull actuator shown in the drawings consists of the mushroom knob 1 with a head part 2 secured to a guide member 3 by screws 4. At the head part 2, a sliding bushing 5 is formed which surrounds an actuating plunger 6 as a sliding guide. A switch section which holds the push-pull actuator in a control panel 7 consists of a lower part 8, and an upper part 9 which is connected to the lower part 8. Upper part 9 is cylindrical and serves as the guide for the guide member 3. A compression spring 10 is braced between guide member 3 and upper part 9 as shown which pushes the mushroom knob 1 towards the operating or "ON" position. The operating position is defined by a stop 12 formed by a nut 11 screwed on the upper part 9. The upper part 9 is provided with rocking levers 13. The rocking levers 13 ar pivoted around axis 14 and are pushed or biased in a radial direction toward the actuating plunger 6 by springs 15. Springs 15 are braced between the rocking levers 13 and the upper part 9. The rocking levers have recesses which in one position are engaged by projections 25 (left side of FIG. 1) and thereby hold the actuating plunger in the upper or "ON" position. The lower sides 17 of the projections 25 rest against the edge of the recesses 16. In the second or "OFF" position, lower surfaces 18 of the rocking levers 13 come into contact with the upper sides 19 of the projections 25 as shown on the right side of FIG. 1. The lower part 8 is mounted on the control panel 7, in a known manner, and includes a further spring 20 which rests on a plunger extension 21. Plunger extension 21 is connected to the actuating plunger 6 by a screw 22. Normally, this spring 20 causes the actuation of the switching element, not shown here in detail, via the plunger extension 21 as soon as the actuating plunger 6 is released by the rocker levers 13. The process of turning off the switch cannot be stopped if the compression spring 20 is intact and the contacts are not welded together.

Figure 1:
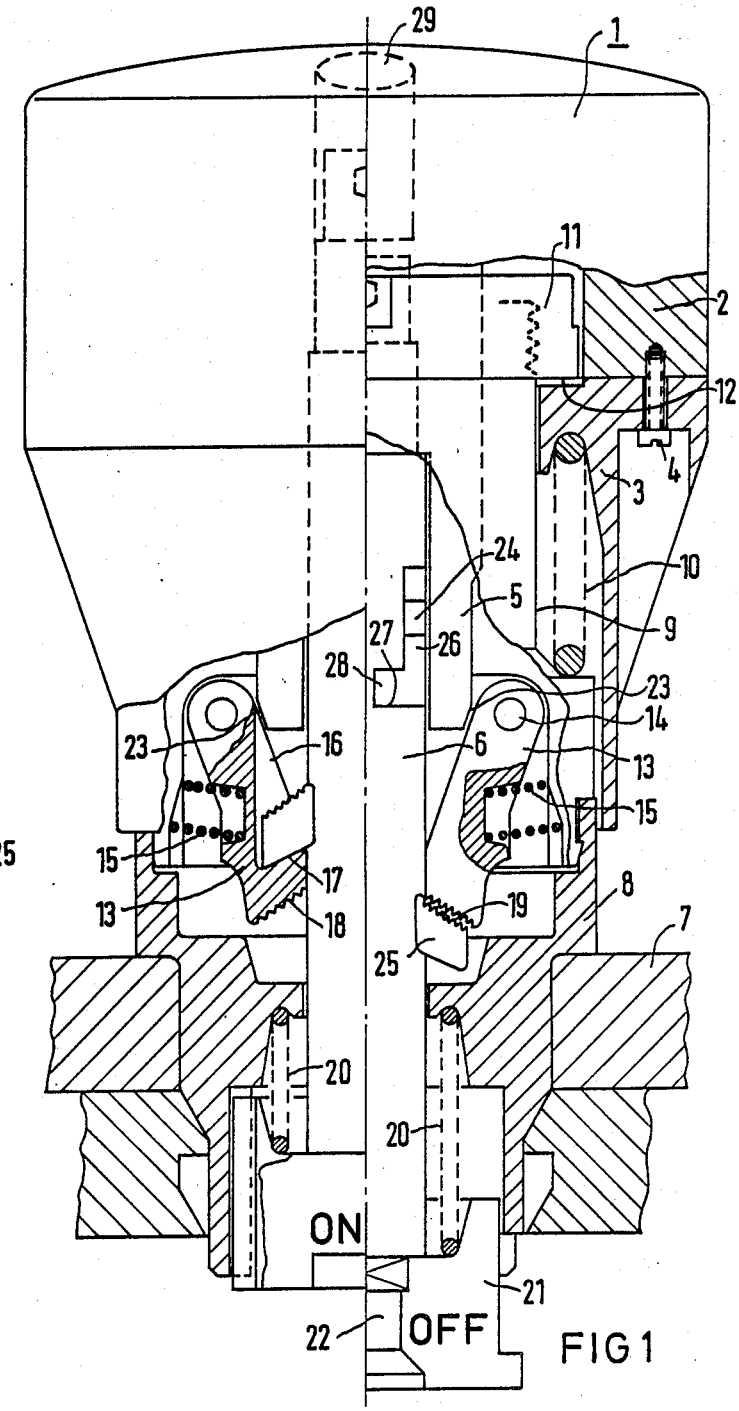
FIG. 1 shows a partial cross-section view of a push-pull actuator, in the operating and turned off position.

The switch operates as follows: in the left part of FIG. 1, the push-pull actuator is shown in the operating position. If now the mushroom knob 1 is moved toward the control panel, the inclined surfaces 23 of the sliding bushing 5 come into contact with the rocker levers 13 and push them out of engagement with the projections 25 against the force of the springs 15 as can be seen in FIG. 2. The spring 20 then causes the actuating plunger 6 to spring forward in the turned-off direction. After the position seen on the right side of FIG. 1 is reached, the rocking levers 13 are again swung in the direction toward the actuating plunger 6 and the lower surfaces 18 thereof come into engagement with the upper sides 19 of the projections 25 so that the actuating plunger cannot rebound. The mushroom knob 1 is thereafter free to return to the position seen in FIG. 1. The structure of the actuating plunger 6 in the mushroom knob 1 is of such a nature, however, that a forced actuation continues to be assured by suitable stops even if spring 20 should be defective. This feature can be accomplished, for instance, by a dog 24 which slides in a slot 26 of the actuating plunger 6, without affecting the plunger until it reaches edge 27. When the mushroom is pushed further, the dog pushes edge 27 downward towards the "OFF" position, even if spring 20 is broken. When the mushroom knob is turned, dog 24 enters lateral extension 28. When the mushroom knob is pulled back, it pulls the plunger with it toward the "ON" position. Alternatively, the actuating plunger can be pushed back as shown on the left side as seen from FIG. 1, through the opening 29. In this configuration the opening also serves as an indicator opening for the push-pull actuator. After the rocker levers have been brought into the position shown in FIG. 2, the mushroom knob 1 and actuating plungers 6 are then returned likewise.

Obviously, numerous modifications can be made to the invention without departing from its scope as defined in the appended claims.

What is claimed is:

1. A push-pull actuator for switches, the actuator comprising:

a mushroom knob, the mushroom knob being movable longitudinally between a rest position and an operating position;

a first spring, the first spring biasing the mushroom knob toward the rest position;

an actuating plunger, the actuating plunger movable between an ON position and an OFF position;

a second spring, the second spring biasing the actuating plunger in a predetermined direction toward one of the ON positions and the OFF position;

at least one detent, the detent selectively maintaining the actuating plunger in one of the ON position and the OFF position against the bias of the second spring, the mushroom knob being movable with respect to the actuating plunger for disengaging the detent means at least when the plunger is in one of the ON position and the OFF posiiton, the mushroom knob being movable into direct contact with the actuating plunger so as to allow movement of the actuating plunger in the direction of biasing of the second spring when the second spring fails to bias the actuating plunger;

wherein the mushroom knob includes an inclined surface and the at least one detent comprises a spring loaded latch, the spring loaded latch having a recess; and the actuating plunger having a projection, the projection extending into the recess such that the actuating plunger is engaged by the latch when the actuating plunger is in the ON position.

2. The push-pull actuator of claim 1, wherein the inclined surface of the mushroom knob is movable into and out of camming contact with the latch so as to selectively disengage the projection from the latch.

3. The push-pull actuator of claim 1, wherein the mushroom knob has an outer surface and an opening extending between the outer surface and the actuating plunger so that the actuating plunger can be reached for switching.

4. The push-pull actuator of claim 1, wherein the actuating plunger includes a plurality of projections, each projection having a first side and a second side, the push-pull actuator comprising a plurality of latches, each of the latches comprising a pivotable rocker lever, each of the rocker levers comprising a latching recess for engagement with the first side of one of the plurality of actuating plunger projections in the ON position and a surface matched to the second side of one of the actuating plunger projections such that the actuating plunger can be locked in the OFF position, each rocker lever being pivotable between an engagement position and a disengagement position.

5. The push-pull actuator of claim 4, wherein the second side of each of the plurality of actuating plunger projections includes a plurality of grooves and the surface of each rocker lever which is matched to the second side of the actuating plunger projection includes a plurality of matching grooves.

* * * * *